US008782883B2

(12) United States Patent
Shimizu

(10) Patent No.: US 8,782,883 B2
(45) Date of Patent: Jul. 22, 2014

(54) METHOD OF PRODUCING A FEMALE TERMINAL

(75) Inventor: Tooru Shimizu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 284 days.

(21) Appl. No.: 13/370,675

(22) Filed: Feb. 10, 2012

(65) Prior Publication Data

US 2012/0144669 A1 Jun. 14, 2012

Related U.S. Application Data

(62) Division of application No. 13/029,529, filed on Feb. 17, 2011, now Pat. No. 8,257,120.

(30) Foreign Application Priority Data

Feb. 19, 2010 (JP) ..... 2010-035152

(51) Int. Cl.
*H01R 43/04* (2006.01)

(52) U.S. Cl.
USPC ..... 29/882; 29/874

(58) Field of Classification Search
USPC ..... 29/882, 825, 874; 439/842, 844, 851, 439/852
See application file for complete search history.

(56) References Cited

U.S. PATENT DOCUMENTS

| | | | | |
|---|---|---|---|---|
| 3,784,965 | A * | 1/1974 | Murphy | 439/844 |
| 4,345,373 | A * | 8/1982 | Lacaze, Jr. | 29/874 |
| 4,810,214 | A | 3/1989 | Yohn | |
| 2004/0185722 | A1 | 9/2004 | Conrad | |

* cited by examiner

*Primary Examiner* — Thiem Phan
(74) *Attorney, Agent, or Firm* — Gerald E. Hespos; Michael J. Porco; Matthew T. Hespos

(57) ABSTRACT

A female terminal (30) has a main portion (31) and contact pieces (32) that project from that main portion (31) in a facing state. A male terminal (80) is accommodated into an accommodation space (35) surrounded by the contact pieces (32). The accommodation space (35) is mainly formed by horizontal holes (38) that open laterally. Cross-sectional shapes of surfaces (S) of the contact pieces (32) forming the horizontal holes (38) cut along a cutting plane crossing an axial center of the main portion (31) are straight lines.

7 Claims, 19 Drawing Sheets

METHOD OF PRODUCING A FEMALE TERMINAL

CROSS REFERENCE TO RELATED DOCUMENTS

This application is a Division of U.S. application Ser. No. 13/029,529, filed Feb. 17, 2011, now U.S. Pat. No. 8,257,120, which claims priority to Japanese Application Nos. 2010-035152, filed Feb. 19, 2010.

BACKGROUND OF THE INVENTION

1. Field of the Invention

The invention relates to a female terminal and a production method for a female terminal.

2. Description of the Related Art

Japanese Unexamined Patent Publication No. H09-63676 discloses a known female terminal into which a bar-shaped male terminal is fittable. The female terminal includes a substantially cylindrical terminal accommodating portion extending in forward and backward directions, and slits extending back from the front edge of the terminal accommodating portion. The slits are formed by slotting, and are arranged radially about an axial center of the terminal accommodating portion. The slits divide the terminal accommodating portion into a plurality of contact pieces that surround and press the male terminal when the male terminal fitting is fit in the terminal accommodating portion. Thus, the male and female terminals are connected electrically conductively.

The female terminal is formed using a round bar material. As shown in FIG. 23, a terminal connection hole 2 is formed in a round bar material 1, and the round bar material 1 is cut back from the front end thereof to form slits 3. The slits 3 form a plurality of contact pieces 4 around the terminal connection hole 2. Subsequently, as shown in FIG. 23, spinning is applied to the respective contact pieces 4 to bend base ends of the respective contact pieces 4 inwardly. A contact 5 is formed by leading end portions of the respective contact pieces 4 and an inner diameter of the contact 5 is smaller than an outer diameter of the male terminal. Thus, the respective contact pieces 4 are deformed resiliently out by the male terminal and the male terminal is pressed into contact with the contact 5 due to the resilient restoring forces of the respective contact pieces 4 when the male terminal is fit into the female terminal.

However, the finished shape of the contact portion 5 may be disrupted due to the spinning that is applied to the respective contact pieces 4. In other words, the finished shape of the contact portion 5 is likely to vary even if the influence of springback and the like is considered in an effort to obtain a predetermined finished shape by spinning. Thus, a contact area of the contact portion 5 and the male terminal may become smaller to increase contact resistance. Further, specifications may require a controlled standard interval t between the respective contact pieces 4 in the contact portion 5. However, the application of spinning to the respective contact pieces 4 will result in a larger variation of the interval t. Therefore, it has been difficult to produce a female terminal to meet the specification for the interval t. Hence, a production method for forming a female terminal only by a cutting process with high machining accuracy has been much needed for the production of a female terminal.

Spaces that separate the circumferentially adjacent contact pieces of the above-described female terminal are formed only by the long narrow slits. Foreign matter that may enter an accommodation space surrounding the contact pieces is not easily discharged through the slits. Thus, foreign matter may accumulate in the accommodation space to reduce connection reliability.

The present invention was developed in view of the above situation and an object thereof is to make a foreign matter easily dischargeable to the outside even if the foreign matter enters an accommodation space surrounded by a plurality of contact pieces.

SUMMARY OF THE INVENTION

The invention relates to a female terminal with a main portion and opposed facing contact pieces that project forward from the main portion. A male terminal can be accommodated in an accommodation space at least partly surrounded by the contact pieces. The accommodation space is formed mainly by a plurality of longitudinal or horizontal holes that are open laterally. Thus, foreign matter that may enter the accommodation space can be discharged easily to the outside through the longitudinal or horizontal holes. Further, the cross-sectional shapes of the longitudinal or horizontal holes in a direction crossing the main portion are straight lines. Thus, the longitudinal or horizontal holes can be formed, for example, using a drill.

The longitudinal or horizontal holes may penetrate through a front part of the main portion in a direction crossing the axial center of the main portion. Thus, foreign matter is discharged even more easily to the outside and the longitudinal or horizontal holes are formed more easily by cutting.

The longitudinal or horizontal holes may be long holes extending in an axial center direction of the main portion. Thus, the longitudinal or horizontal holes can be utilized as parts of spaces separating the adjacent contact pieces.

The longitudinal or horizontal holes may be correspond to spaces separating the circumferentially adjacent contact pieces. Thus, the longitudinal or horizontal holes can be used as spaces that separate circumferentially adjacent contact pieces.

The female terminal may further comprise a guide hole to guide a leading end of the male terminal into the accommodation space.

Outer circumferential ribs may be formed at positions substantially corresponding to a terminal connection hole on the outer circumferential surfaces of the contact pieces.

The invention also relates to a production method for a female terminal, such as the above-described terminal. The method includes cutting a bar material extending in forward and backward. The method continues by forming longitudinal or horizontal holes that are open in lateral portions of the bar material. The method then proceeds by forming slits that are arranged radially about an axial center of the bar material to divide the bar material into the plurality of contact pieces. The method then forms a contact portion. This part of the method may include setting a jig to substantially face outer surfaces of the contact pieces with a clearance between the jig and the outer surfaces of the contact pieces and forming a terminal connection hole that communicates with the longitudinal or horizontal holes from a front end portion of the bar material in a state where the plurality of contact pieces are deformed resiliently into the clearance and held in contact with the jig.

According to this method, the bar material can be divided into the contact pieces by forming the longitudinal or horizontal holes and forming the plurality of slits. The contact portion can be formed by forming the terminal connection hole. Thus, machining accuracy of the female terminal can be improved by forming the female terminal only by a cutting process.

The terminal connection hole may be formed by a drill with the same diameter as the male terminal. Thus, an inner periphery of the terminal connection hole and an outer periphery of the male terminal can coincide if a cross-sectional shape of the male terminal is right circular. In other words, processing the terminal connection hole by the drill duplicates a state where the male terminal is fit into the terminal connection hole. Therefore, the contact portion can be entirely in surface contact with the male terminal.

Resilient displacement amounts of the contact pieces into the clearance may correspond to resilient displacement amounts when the male terminal is held. Thus, displacement amounts of the contact pieces are controlled by setting a dimension of the clearance.

The method may include forming a guide hole in the front end of the bar material before forming the slit, and the terminal connection hole may be formed relative to the guide hole. Thus, the male terminal can be guided to the contact portion by the guide hole. Further, time required to form the terminal connection hole can be shortened by first forming the guide hole.

As the drill is inserted into the guide hole, the guide hole may be widened initially by an inclined surface at the leading end of the drill and the outer surfaces of the contact pieces contact the inner circumferential surface of the jig. Thus, resilient displacements of the contact pieces are restricted.

Outer circumferential ribs may be formed at positions corresponding to a terminal connection hole on the outer circumferential surfaces of the contact pieces.

A distance from an opening edge of the jig to a leading end of the drill may be so set that the outer circumferential ribs are at least partly accommodated into the jig before an inclined surface at a leading end of the drill comes contact the inner circumferential surface of the guide hole to widen the guide hole, and the outer circumferential ribs slide in contact with the inner circumferential surface of the jig with the contact pieces resiliently deformed by a specified amount.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
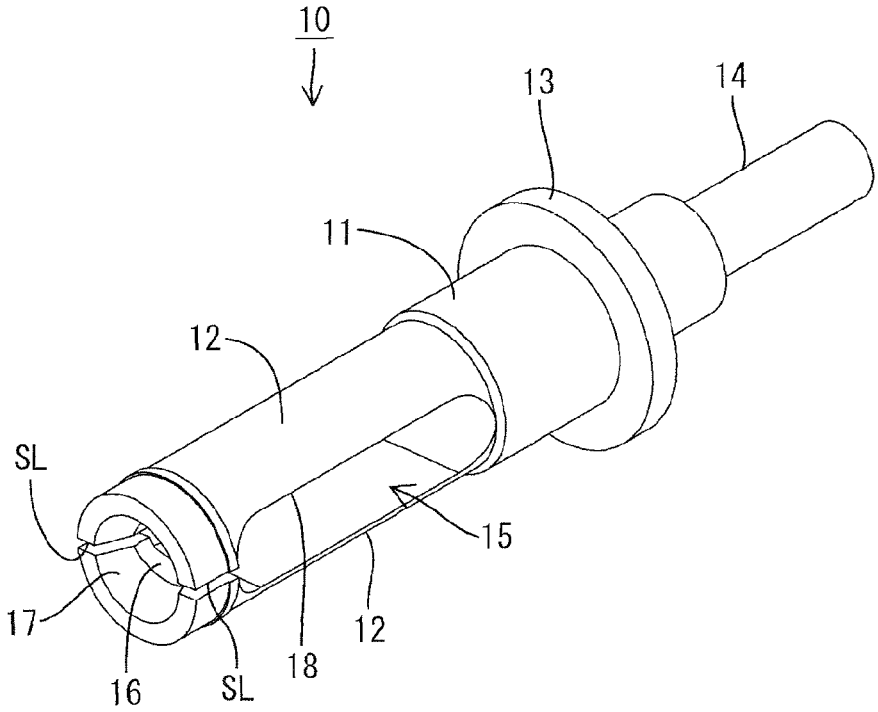
FIG. 1 is a perspective view of a female terminal in a first embodiment.
Figure 2:
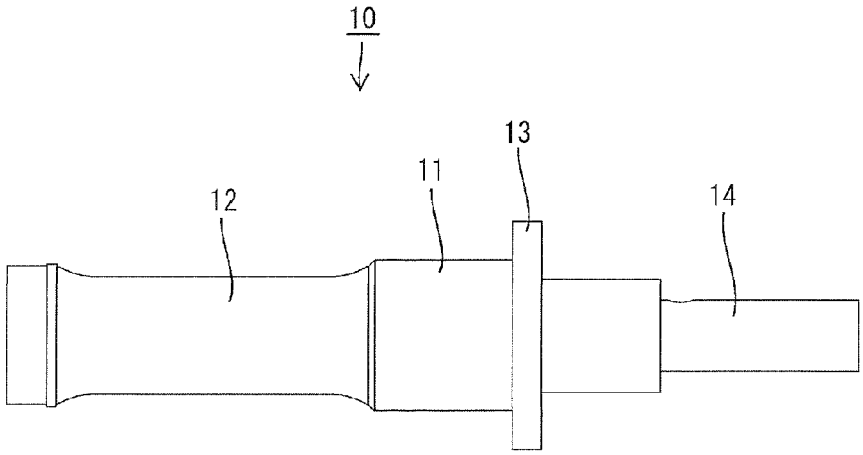
FIG. 2 is a plan view of the female terminal.
Figure 4:
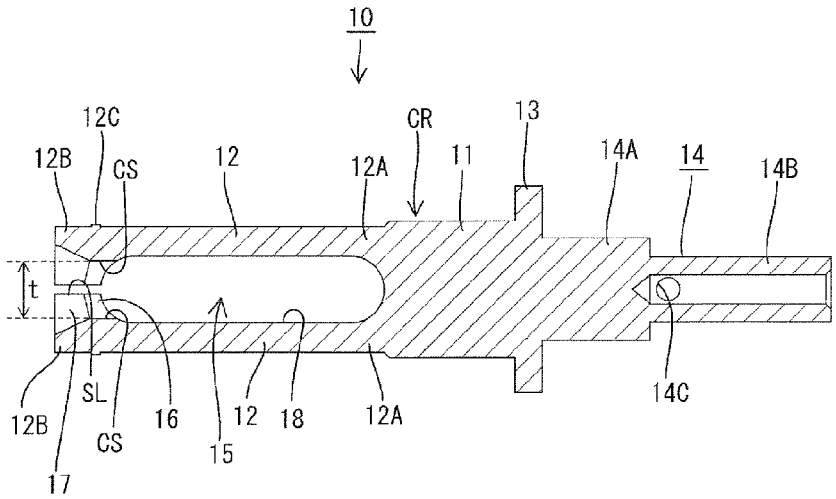
FIG. 4 is a section along A-A of FIG. 3.
Figure 5:
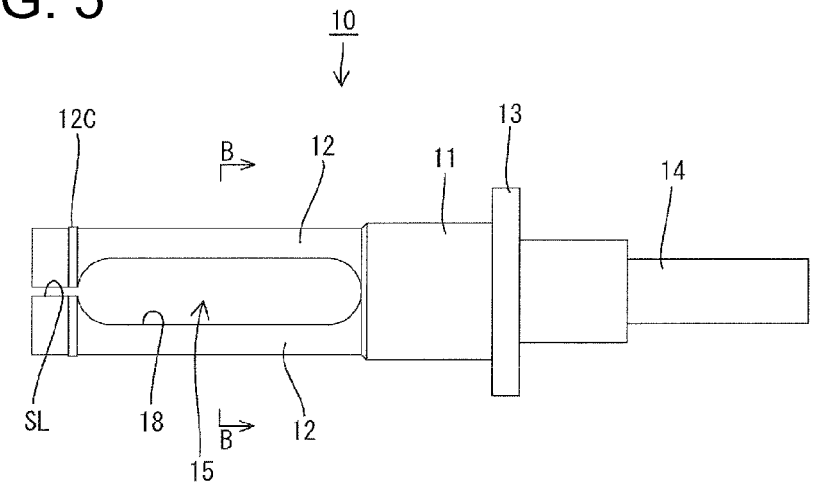
FIG. 5 is a side view of the female terminal.
Figure 6:
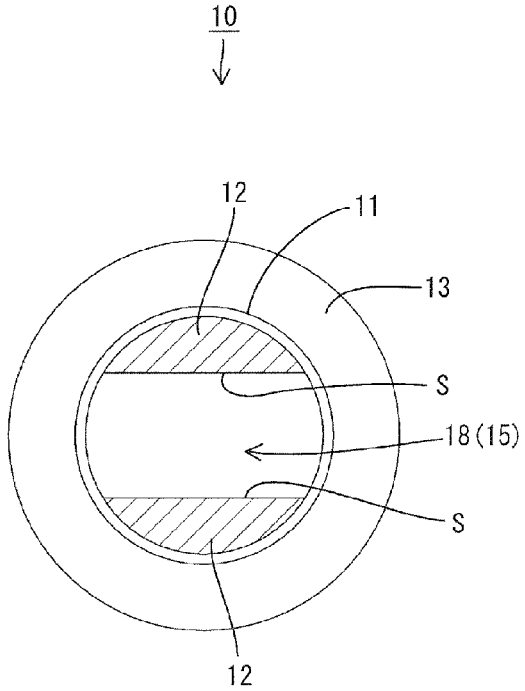
FIG. 6 is a section along B-B of FIG. 5.

A first embodiment of the invention is described with reference to FIGS. 1 to 14. A female terminal 10 in the first embodiment has a substantially cylindrical outer peripheral shape as shown in FIG. 1. The female terminal 10 is long in forward and backward directions, as shown in FIG. 2. The left side and right side in FIG. 2 are referred to respectively to as the front and rear in the following description. As shown in FIG. 5, the female terminal 10 includes a main portion 11 arranged in a central part in forward and backward directions, two contact pieces 12 projecting forward from the main portion 11 while facing each other, a flange 13 circumferentially provided at the rear end of the main portion 11, a wire connection barrel 14 projecting back from the main portion 11.

Figure 3:
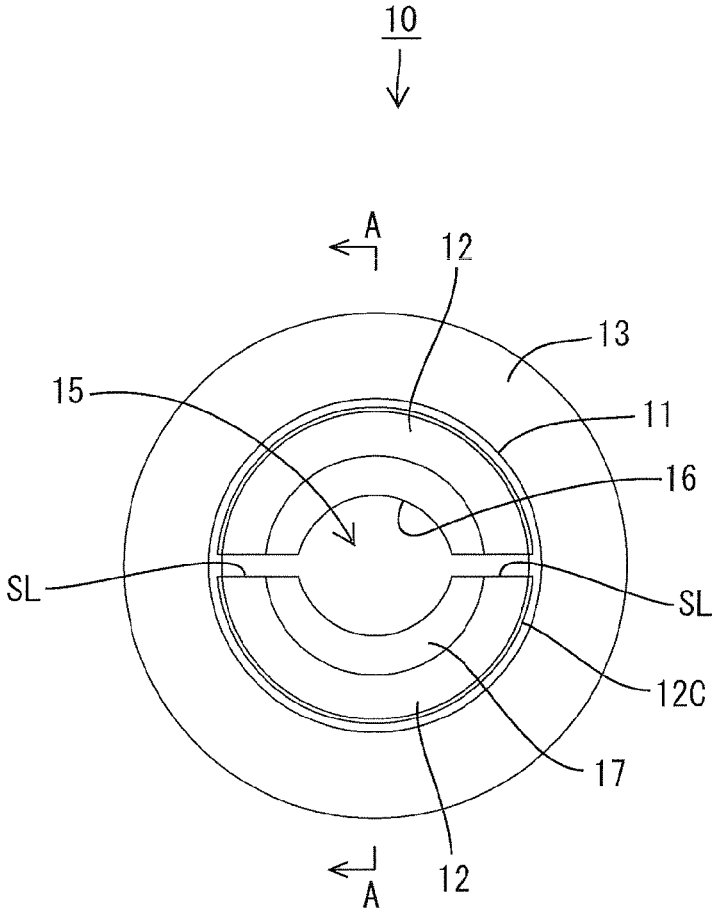
FIG. 3 is a front view of the female terminal.

As shown in FIG. 3, the flange 13 substantially projects radially out from the outer circumferential surface of the main portion 11 over the entire circumference. The flange 13 contacts the rear end opening edge of a cavity (not shown) into which the female terminal 10 is accommodated. Thus, the female terminal 10 is prevented from moving any farther forward while accommodated in the cavity. On the other hand, as shown in FIG. 4, the barrel 14 includes a solid small-diameter portion 14A having a smaller diameter than the main portion 11 and a substantially cylindrical tube 14B formed behind the small-diameter portion 14A. A core exposed at an end of a wire (not shown) can be inserted into the tube 14B. The tube 14B then is crimped to connect the female terminal 10 and the wire electrically conductively. At least one water drain hole 14C penetrates laterally through a front end portion of the tube 14B.

Figure 14:
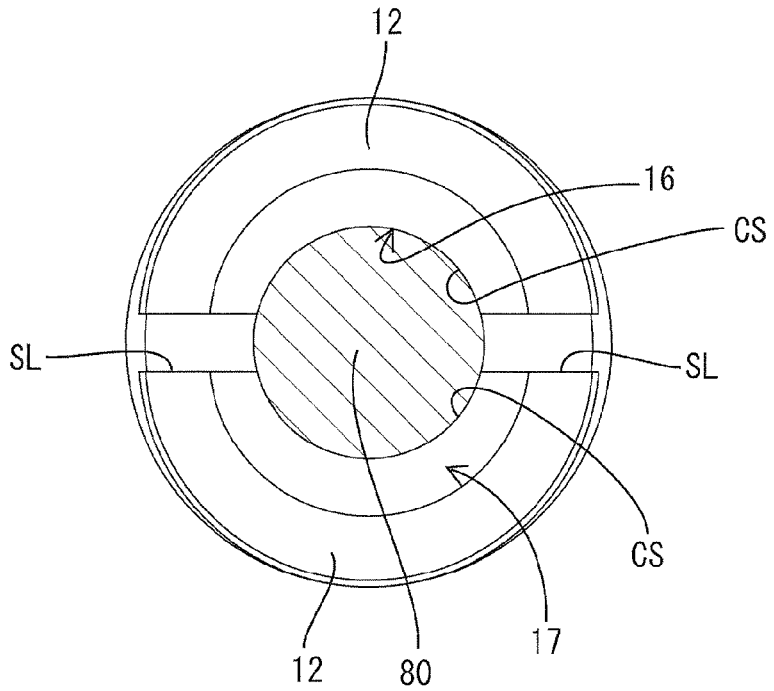
FIG. 14 is a front view of the female terminal showing a state where both arcuate surfaces are entirely held in contact with a male terminal.

An accommodation space 15 is defined between the contact pieces 12 and can receive a round bar-shaped male terminal 80 (see FIG. 14). In other words, the accommodation space 15 is defined by substantially facing surfaces of the contact pieces 12. A terminal connection hole 16 is formed at inner sides of front ends of the contact pieces 12 and defines surfaces where the contact pieces 12 connect to the male terminal 80. Further, a guide hole 17 is formed before the terminal connection hole 16 and widens toward the front. The accommodation space 15 is open forward via the terminal connection hole 16 and the guide hole 17.

As shown in FIG. 5, the accommodation space 15 is formed mainly by a horizontal or longitudinal hole 18 that is long in forward and backward directions. More particularly, the accommodation space 15 is composed of the horizontal hole 18, the terminal connection hole 16 and the guide hole 17. The horizontal hole 18 penetrates through opposite lateral portions of a substantially round bar material CR by a drill, as described in detail later. Here, the round bar material CR is a base material used to produce the female terminal 10. In the following description, an intermediate product in the process of producing the female terminal 10 is called the round bar material CR.

Although the single horizontal hole 18 penetrates through the opposite lateral portions of the round bar material CR in this embodiment, two horizontal or longitudinal holes 18 may be formed and may open at opposite left and right sides of the round bar material CR with respect to an axial center of the main portion 11. The horizontal holes 18 are processed at once by the drill and hence appear as a single horizontal hole 18. Thus, in the case of the female terminal 10 of this embodiment, i.e. the forked terminal with two contact pieces 12, two horizontal holes 18 would be formed, but they can be formed at once. Note that, in the following description, the two horizontal holes 18 are called the horizontal hole 18 in some cases.

A cross-sectional shape of a surface S of the contact piece 12 forming the horizontal hole 18 cut along a cutting plane (section along B-B of FIG. 5) crossing the axial center of the main portion 11 is a straight line. In other words, in this embodiment, both upper and lower surfaces S forming the horizontal hole 18 are substantially flat surfaces, as shown in a section of FIG. 6.

Figure 13:
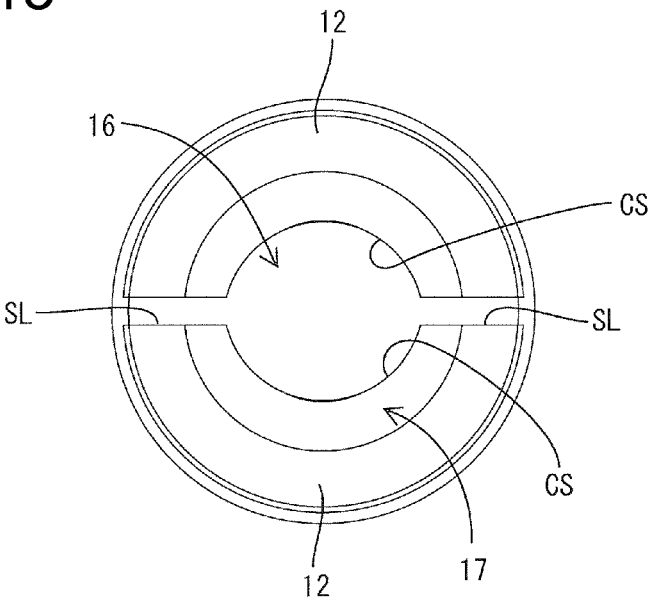
FIG. 13 is a front view of the round bar material showing a state where the terminal connection hole is formed.

As shown in FIG. 13, the terminal connection hole 16 is defined by upper and lower arcuate surfaces CS, and a contact portion with the male terminal 80 is formed by the arcuate surfaces CS. The arcuate surfaces CS substantially conform to the outer peripheral shape of a drill DR for processing the terminal connection hole 16. Further, since outer diameters of the drill DR and the male terminal 80 are substantially are equal, the arcuate surfaces CS also conform to the outer peripheral shape of the male terminal 80. Thus, as shown in FIG. 14, the arcuate surfaces CS are arranged on the same circumference and the contact portion formed by the both arcuate surfaces CS is substantially entirely held in surface contact with the male terminal 80 when the male terminal 80 is fit into the terminal connection hole 16.

Figure 12:
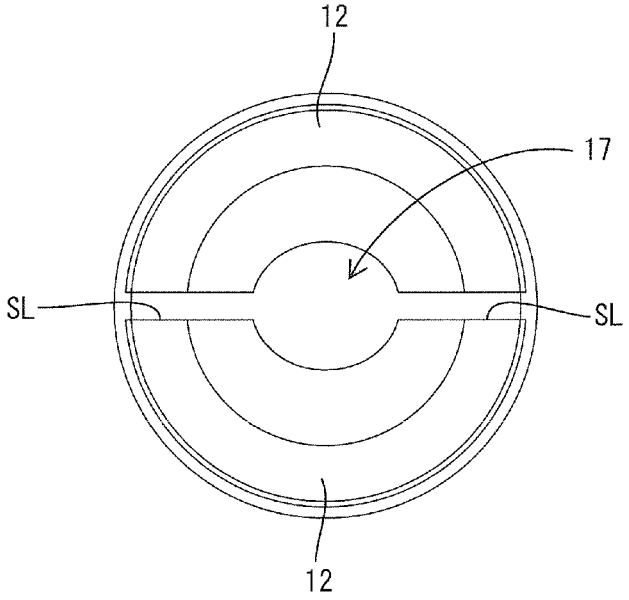
FIG. 12 is a front view of the round bar material showing a state where the guide hole is formed.

As shown in FIGS. 1 and 4, the guide hole 17 is open forward and widens toward the front so as to guide the leading end of the male terminal 80 into the terminal connection hole 16. As shown in FIG. 12, the guide hole 17 has a substantially conical or converging shape in a front end portion of the round bar material CR and communicates with the horizontal holes 18. The guide hole 17 is formed by applying a cutting process such as boring to the front end portion of the (round) bar material CR.

As shown in FIG. 4, the contact pieces 12 are resiliently deformable in directions to increase and decrease a distance t between the arcuate surfaces CS in the terminal connection hole 16. In other words, the contact pieces 12 are displaceable with rear ends 12A as supports in directions to bring front ends 12B closer to and away from each other. An outer diameter of the round bar material CR at the contact pieces 12 is somewhat smaller than that of the round bar material CR at the main portion 11. Further, outer circumferential ribs 12C are formed at positions substantially corresponding to the terminal connection hole 16 on the outer circumferential surfaces of the contact pieces 12.

The contact pieces 12 are formed by making left and right slits SL in a part of the round bar material CR before the horizontal holes 18 to divide a front part of the main portion 11 into first and second sections. The slits SL are formed by cutting the round bar material CR back from the front end toward the front ends of the horizontal holes 18 using a slotting cutter or the like. The slits SL are formed in a range of the round bar material CR from the guide hole 17 to the terminal connection hole 16. Note that the slits SL are formed only in the front end of the round bar material CR since spaces separating the two vertically adjacent contact pieces 12 are formed mostly by the horizontal holes 18.

Figure 7:
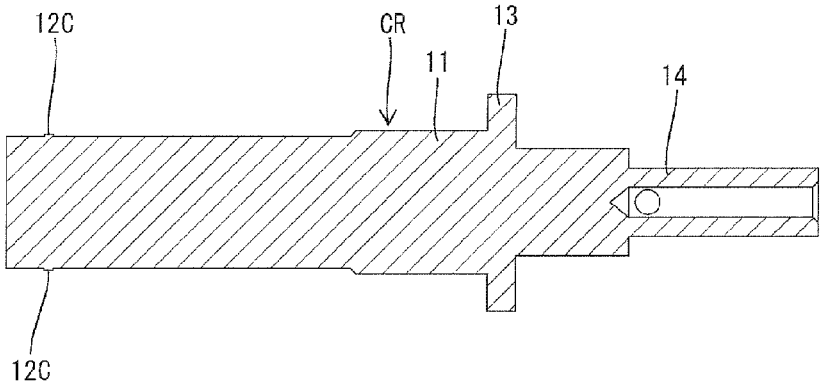
FIG. 7 is a section corresponding to FIG. 4 showing a state before longitudinal or horizontal holes are formed in a round bar material.
Figure 8:
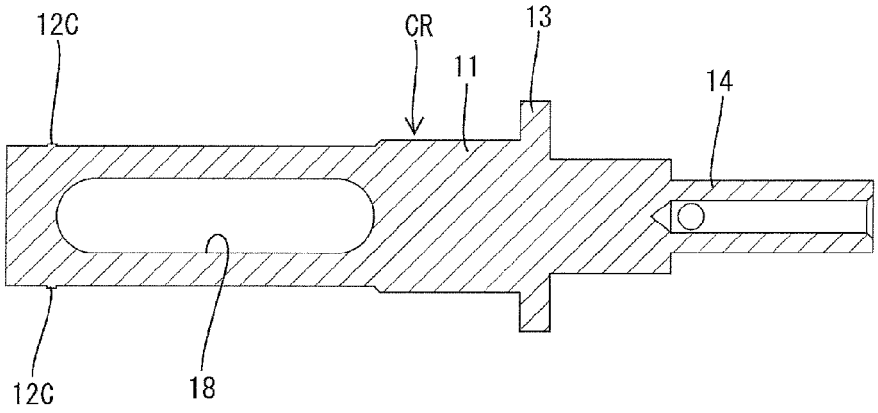
FIG. 8 is a section showing a state where the longitudinal or horizontal holes are formed in the round bar material of FIG. 7.

As shown in FIG. 7, the substantially round bar material CR formed with the main portion 11, the flange 13 and the barrel 14 is prepared beforehand, for example, by cutting a rod as a base material. Upon forming the accommodation space 15, the bar material CR is processed with a drill (not shown) so that the opposite lateral portions are penetrated, as shown in FIG. 8. The drill then is moved in forward and backward directions along the axial center of the bar material CR to form the long horizontal or longitudinal holes 18.

The guide hole 17 then is formed in the front end portion of the round bar material CR, as shown in FIG. 12, and communicate with the horizontal or longitudinal holes 18, thereby forming the round bar material CR that is open forward and laterally. Further, the slotting cutter or the like is used to form the slits SL at the substantially opposite left and right sides of the front end portion of the round bar material CR where the guide hole 17 is formed. As a result, the slits SL divide the front part of the main body 11 into the first and second contact pieces 12.

Figure 9:
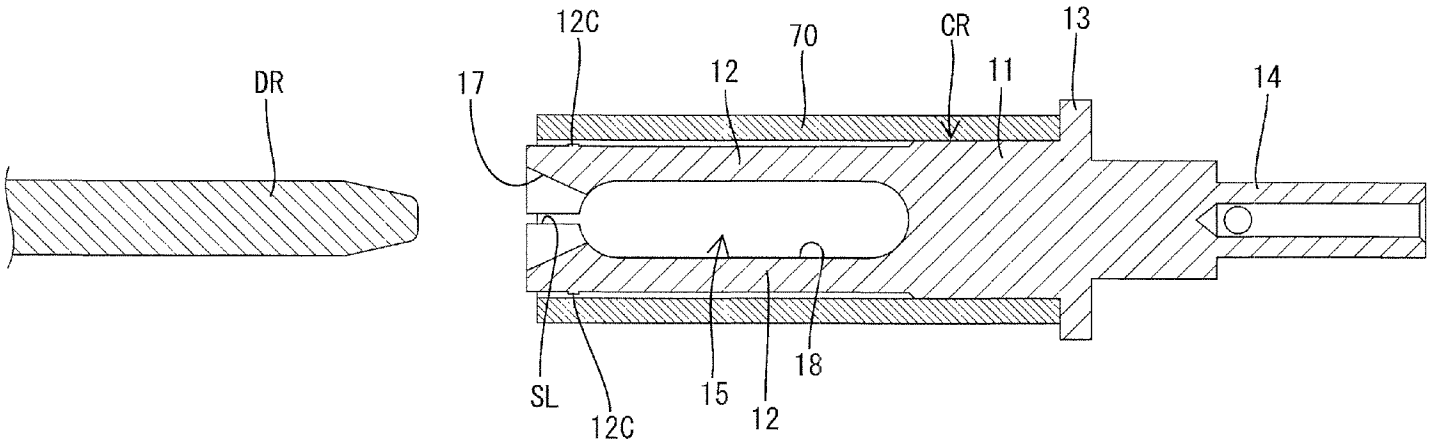
FIG. 9 is a section showing a state where the round bar material of FIG. 8 is set in a jig.
Figure 10:
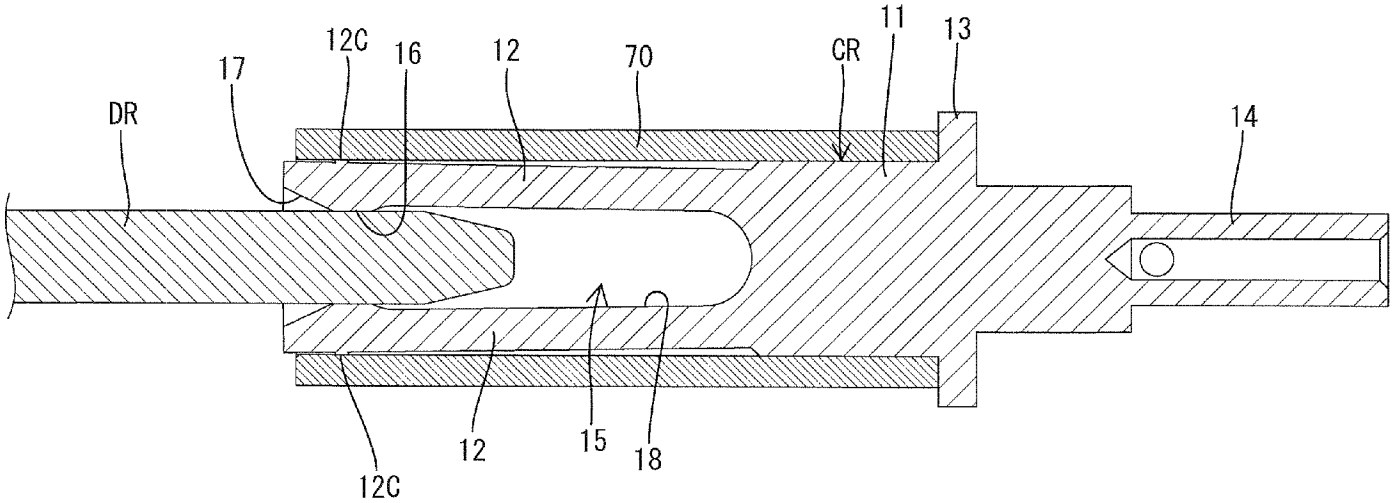
FIG. 10 is a section showing a state where, after a guide hole is formed in the round bar material of FIG. 9, a drill is inserted into the guide hole to process a terminal connection hole.
Figure 11:
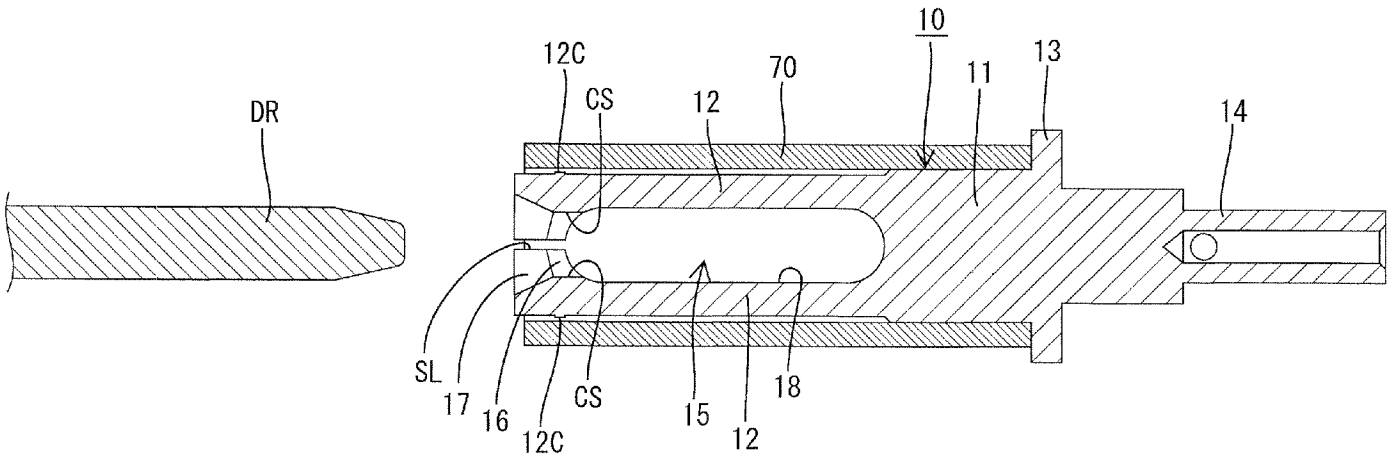
FIG. 11 is a section showing a state where the drill is withdrawn from the terminal connection hole of FIG. 10.

Subsequently, as shown in FIG. 9, the round bar material CR formed with first and second contact pieces 12 is inserted into a substantially cylindrical jig 70 from behind. Thus, the flange 13 contacts the rear end opening edge of the jig 70 and the front end of the round bar material CR projects slightly forward from the front end opening edge of the jig 70, but the outer circumferential ribs 12C of the contact pieces 12 remain in the jig 70. The jig 70 having the round bar material CR therein then is mounted and fixed to a processing apparatus and machining by the drill DR is performed.

A clearance formed between the outer circumferential ribs 12C and the inner circumferential surface of the jig 70 is set to be substantially equal to resilient displacement amounts of the respective contact pieces 12 when the male terminal 80 is fit into the terminal connection hole 16. On the other hand, the outer diameter of the drill DR is substantially set to be equal to the outer diameter of the male terminal 80. Further, a minimum inner diameter of the guide hole 17 before the terminal connection hole 16 is smaller than the outer diameter of the drill DR.

The guide hole 17 is widened by an inclined surface at the leading end of the drill DR as the tapered drill DR is inserted into the guide hole 17 and the outer circumferential ribs 12C contact the inner circumferential surface of the jig 70 to restrict resilient displacements of the contact pieces 12. The terminal connection hole 16 is formed by cutting the inner circumferential surface of the guide hole 17 with the drill DR in this state. A state where the terminal connection hole 16 is formed by the drill DR duplicates a state where the male terminal 80 is inserted in the terminal connection hole 16. Therefore, an inner diameter of the terminal connection hole 16 widened by the insertion of the male terminal 80 therein coincides with the outer diameter of the male terminal 80.

The contact pieces 12 resiliently return when the drill DR is pulled out from the terminal connection hole 16 to bring the outer circumferential ribs 12C and the inner circumferential surface of the jig 70 out of contact. Simultaneously, the terminal connection hole 16 becomes a somewhat flat elliptical hole, as shown in FIG. 13 due to movements of the first and second contact pieces 12 toward each other. In this way, the female terminal 10 is produced only by the cutting process.

The female terminal 10 may be mounted in a charging connector (not shown) and the male terminal 80 may be mounted in a vehicle-side connector connectable to the charging connector. When the charging connector is connected to the vehicle-side connector, the male terminal 80 is inserted into the terminal connection hole 16 and the first and second contact pieces 12 are resiliently deformed in directions away from each other to widen the terminal connection hole 16, as shown in FIG. 14. In this way, the arcuate surfaces CS are arranged substantially on the same circumference and the contact portion can be held entirely in close surface contact with the outer circumferential surface of the male terminal 80 by resilient restoring forces of the contact pieces 12.

Since the female terminal 10 is produced only by the cutting process. Thus, machining accuracy of the contact portion can be improved. As a result, the interval t of the arcuate surfaces CS at the contact portion is controlled more easily. Further, the terminal connection hole 16 is processed using the drill DR having the same diameter as the male terminal 80. Thus, the contact portion can be held entirely in surface contact with the outer circumferential surface of the male terminal 80. Furthermore, since the clearance is provided between the outer circumferential ribs 12C and the jig 70 and the terminal connection hole 16 is formed with the contact pieces 12 resiliently deformed into this clearance, displacement amounts of the contact pieces 12 can be controlled by setting a dimension of the clearance.

The accommodation space 15 for the male terminal 80 is formed mostly by the horizontal holes 18. Thus, foreign matter that enters the accommodation space 15 is discharged easily to the outside. Also, the upper and lower surfaces S forming the horizontal holes 18 are substantially flat surfaces. Thus, the horizontal holes 18 can be processed by drilling. Further, the horizontal holes 18 penetrate through the opposite lateral portions of the round bar material CR and can be processed at once by drilling. Furthermore, the horizontal holes 18 are long holes in forward and backward directions. Thus, the horizontal holes 18 and the slits SL divide the round bar material CR into a plurality of contact pieces 12.

Figure 16:
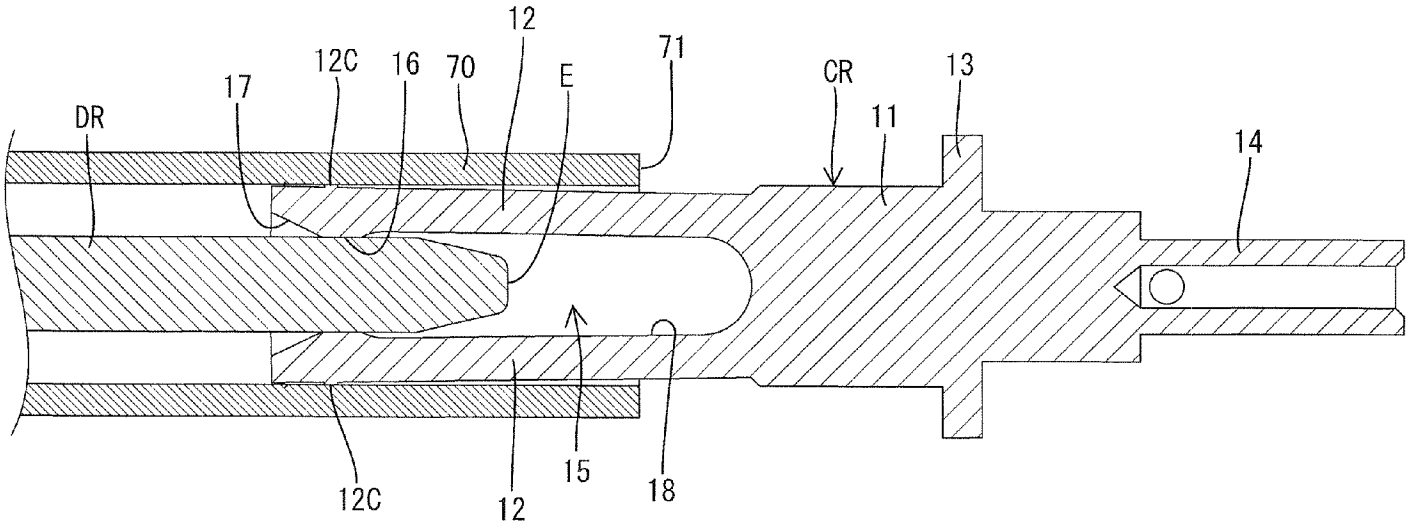
FIG. 16 is a section showing a state where a round bar material of FIG. 15 is set in a drill-side jig and a terminal connection hole is processed by inserting the drill into the guide hole.
Figure 17:
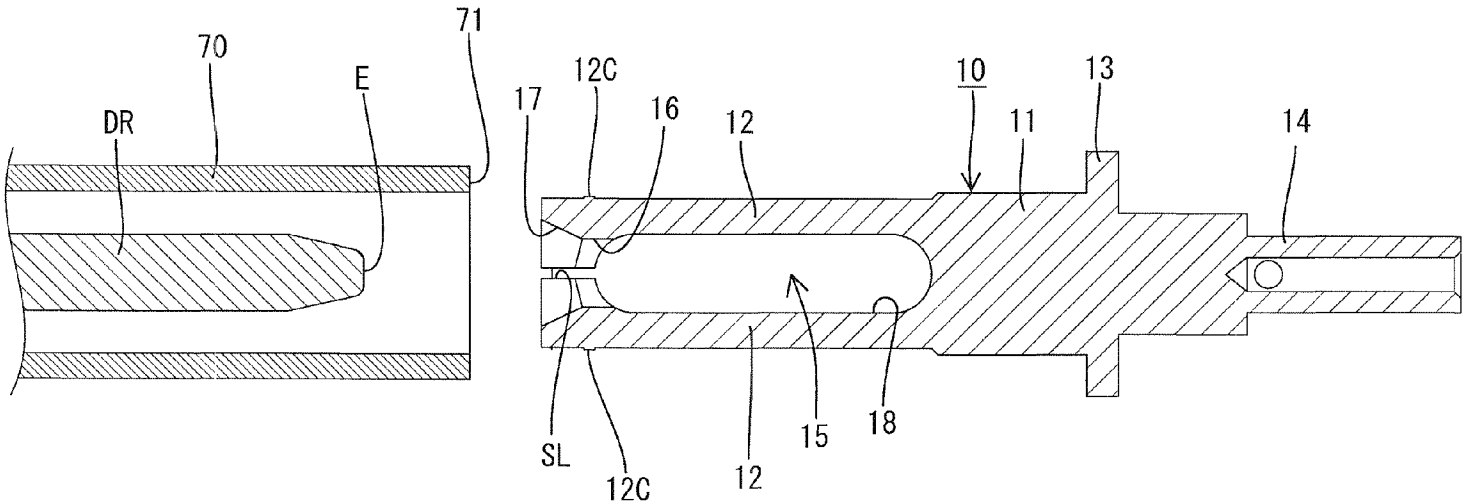
FIG. 17 is a section showing a state where the drill is withdrawn from the terminal connection hole of FIG. 16.

A second embodiment of the invention is described with reference to FIGS. 15 to 17. The second embodiment is obtained by partly changing the method for producing the female terminal 10 according to the first embodiment, and its constructions, functions and effects common or similar to the first embodiment are not described to avoid repeated description. Similar constructions as the first embodiment are identified by the same reference numerals. In the first embodiment, the jig 70 having the round bar material CR set therein is mounted and fixed to the machining apparatus and the round bar material CR is processed by the drill DR. On the contrary, in the second embodiment, the jig 70 is mounted and fixed to the drill DR beforehand and the round bar material CR is processed by the drill DR at the same time as being inserted into the jig 70.

Figure 15:
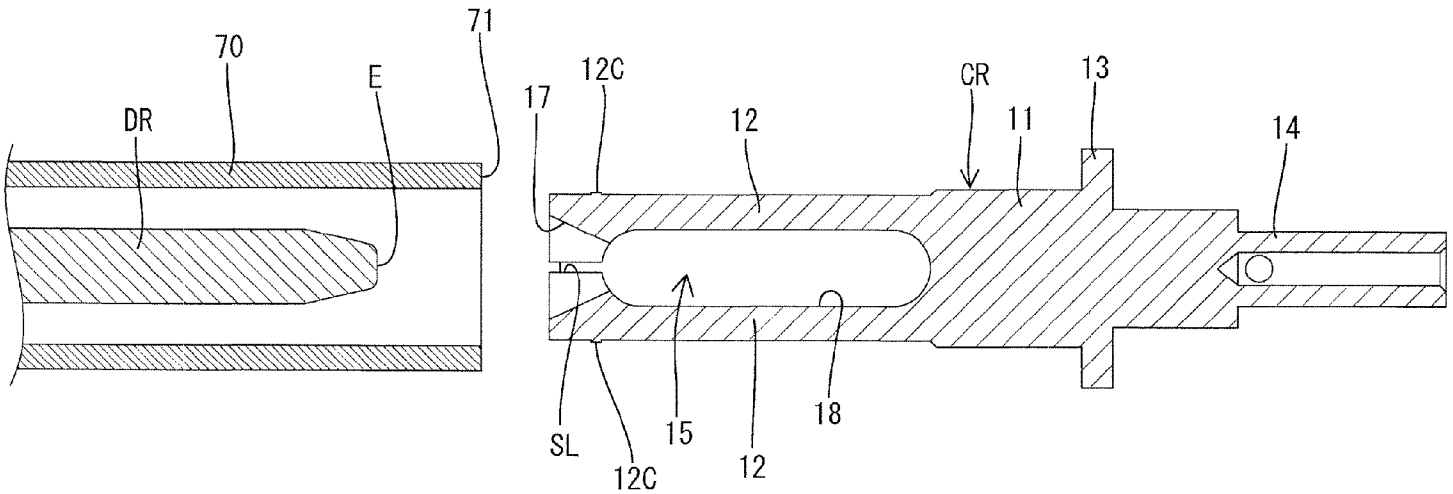
FIG. 15 is a section corresponding to FIG. 10 showing a state before a drill is inserted into a guide hole in a second embodiment.

As shown in FIG. 15, the jig 70 is arranged substantially coaxially with the drill DR so that a leading end E of the drill DR does not project out from an opening edge 71 of the cylindrical jig 70. In other words, a distance from the opening edge 71 of the jig 70 to the leading end E of the drill DR is set so that the outer circumferential ribs 12C are accommodated into the jig 70 before the inclined surface at the leading end of the drill DR contacts the inner circumferential surface of the guide hole 17 to widen the guide hole 17, and the outer circumferential ribs 12C slide in contact with the inner circumferential surface of the jig 70 with the contact pieces 12 resiliently deformed by a specified amount.

According to this production method, time and effort for inserting the round bar material CR into the jig 70 and setting the jig 70 in the processing apparatus can be eliminated. Further, since the jig 70 can be set in the processing apparatus beforehand, the jig 70 and the drill DR can be arranged coaxially and fixed beforehand. Thus, the jig 70 need not be positioned by the main portion 11 and may not be fit up to the main portion 11.

Next, a third embodiment of the invention is described with reference to FIGS. 18 and 19. A female terminal 30 of the third embodiment is obtained by partly changing the construction of the female terminal 10 of the first embodiment, and its constructions, functions and effects common or similar to the first embodiment are not described to avoid repeated description. Constructions similar to the first embodiment are identified by reference numerals obtained by adding 20 to reference numerals representing the respective constructions. The female terminal 10 of the first embodiment is a so-called two-divided terminal, whereas the female terminal 30 of the third embodiment is a so-called three-divided terminal.

Figure 18:
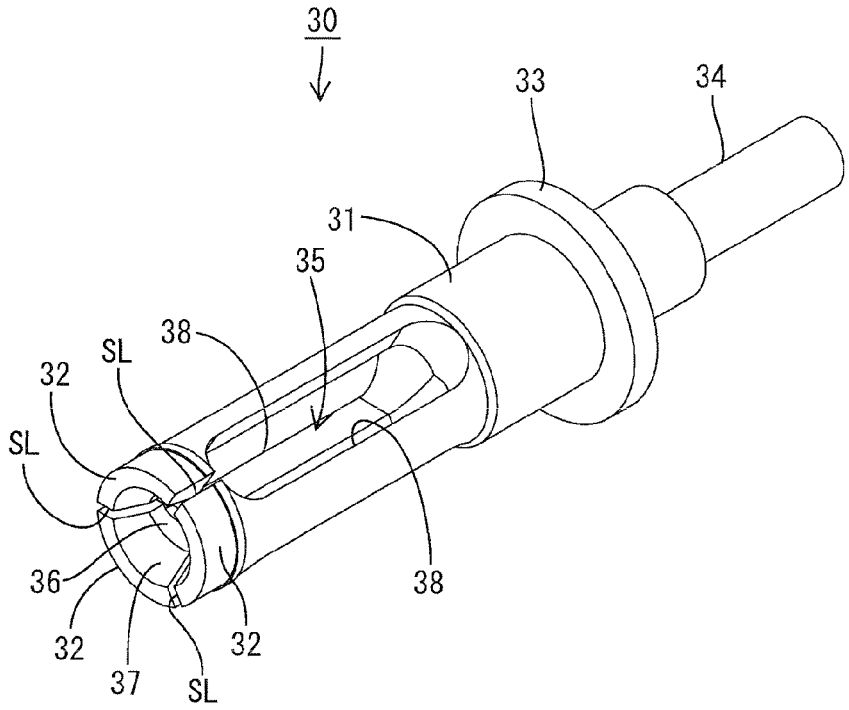
FIG. 18 is a perspective view of a female terminal in a third embodiment.
Figure 19:
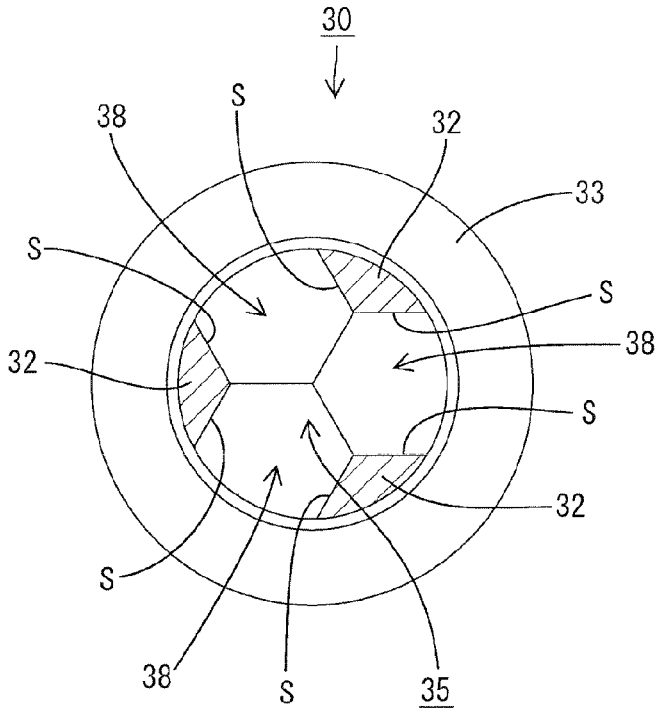
FIG. 19 is a section of longitudinal or horizontal holes of FIG. 18 cut along a cutting plane orthogonal to an axial center direction of a main portion.

In this embodiment, as shown in FIG. 18, three contact pieces 32 are arranged at substantially equal angular intervals (120° intervals) in a circumferential direction about an axial center of a main portion 31. Thus, in the third embodiment, three slits SL are formed radially about the axial center of the main portion 31. In correspondence with these slits SL, horizontal or longitudinal holes 38 are formed behind the respective slits SL to communicate with the slits SL. Thus, it is sufficient to form the slits SL only in a front end portion of the female terminal 30, and time required to process the three slits SL can be shortened.

In this embodiment, three horizontal or longitudinal holes 38 are provided substantially in correspondence with the three slits SL as described above. Since one horizontal hole 38 particularly is formed by two surfaces S as shown in FIG. 19, a total of six surfaces S are arranged in an entire terminal accommodating portion 35. By doing so, foreign matter that enters the terminal accommodating portion 35 can be discharged to the outside of the terminal accommodating portion 35 through the three horizontal holes 38. Therefore, foreign matter can be discharged more easily than the female terminal 10 with two horizontal holes 18 of the first embodiment.

A fourth embodiment of the invention is described with reference to FIG. 20. A female terminal 40 of the fourth embodiment is obtained by partly changing the construction of the female terminal 10 of the first embodiment. Constructions, functions and effects common or similar to the first embodiment are not described to avoid repeated description and are identified by reference numerals obtained by adding 30 to corresponding reference numerals of the first embodiment. The female terminal 40 of the fourth embodiment is a so-called four-divided terminal. In other words, in this embodiment, four contact pieces 42 are arranged at equal angular intervals (90° intervals) in a circumferential direction about an axial center of a main portion 41.

The female terminal 40 of this embodiment is formed by forming additional slits SL in the contact pieces 12 of the female terminal 10 of the first embodiment. In other words, horizontal or longitudinal holes 48 are formed in correspondence with both slits SL arranged at the opposite left and right sides, whereas no horizontal holes are formed in correspondence with both slits SL arranged at the substantially opposite orthogonal upper and lower sides. By doing so, it is sufficient to additionally form upper and lower slits SL in the slit forming step of the first embodiment, and the four-divided female terminal 40 can be produced without drastically changing the production method of the first embodiment.

The present invention is not limited to the above described and illustrated embodiments. For example, the following embodiments are also included in the technical scope of the present invention.

Although the female terminal is formed to have a substantially cylindrical shape in the above embodiments, it may have a rectangular or polygonal tube shape. In other words, if a male terminal is a tab terminal in the form of a flat plate, it is not necessary to form a female terminal to have a cylindrical shape and the female terminal may be formed to have a corresponding tubular shape such as substantially rectangular or polygonal tube shape using a rectangular or polygonal bar material as a base material.

Although the jig 70 is cylindrical in the above embodiments, pressing plates may be arranged at outer sides of the respective contact pieces and resilient deformations of the respective contact pieces may be restricted by these pressing plates.

Although the guide hole is formed in the front end portion of the round bar material CR and the terminal connection hole is formed in this guide hole in the above embodiments, the terminal connection hole may be directly formed in the front end portion of the round bar material CR without forming the guide hole according to the invention.

Figure 20:
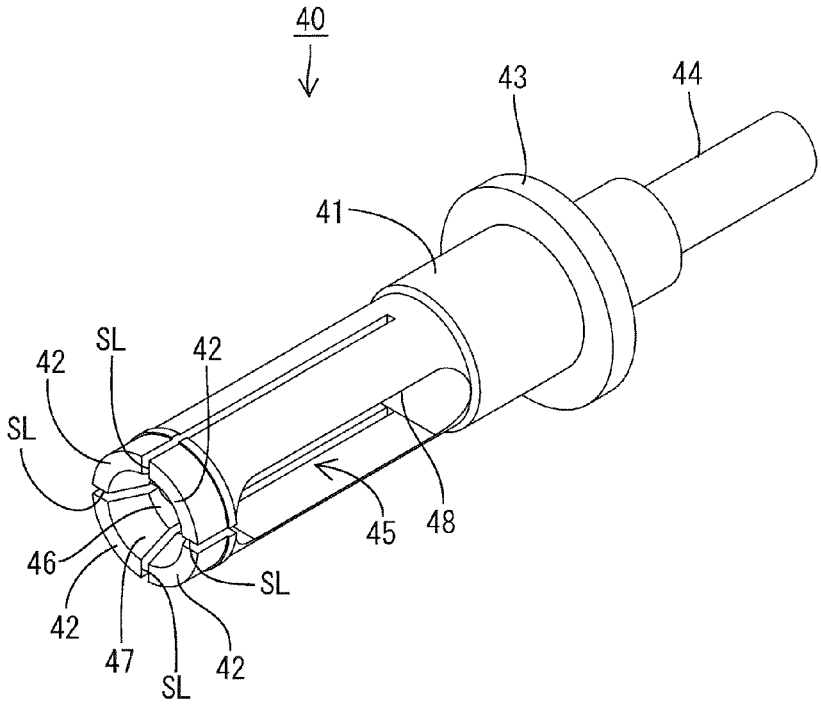
FIG. 20 is a perspective view of a female terminal in a fourth embodiment.
Figure 21:
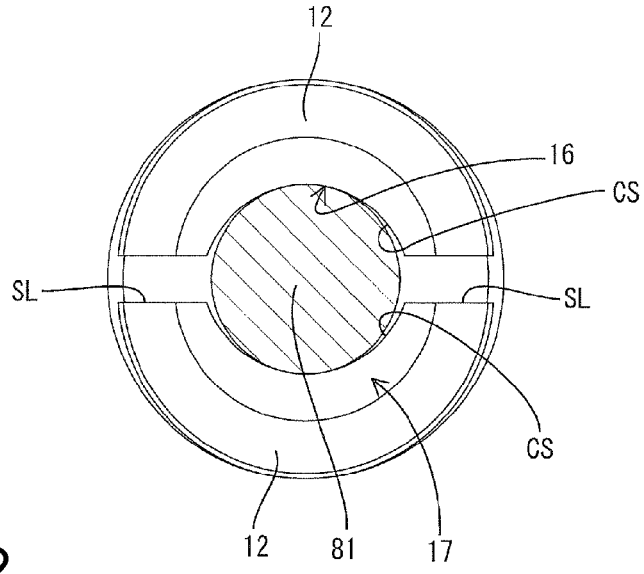
FIG. 21 is a front view of a female terminal in another embodiment showing a state where both arcuate surfaces are partly in contact with a male terminal having a small diameter.
Figure 22:
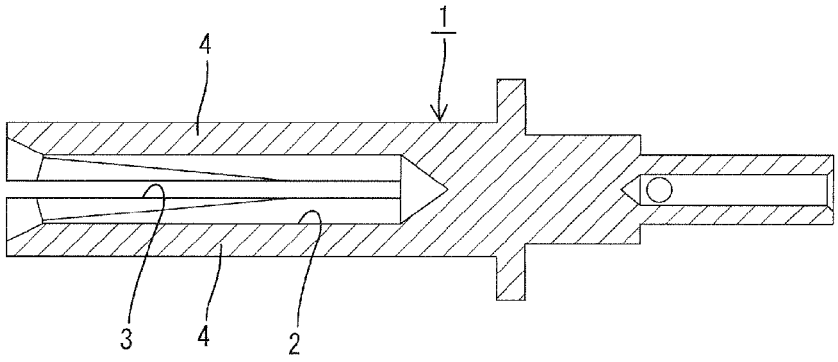
FIG. 22 PRIOR ART
FIG. 22 is a section showing a state before spinning is applied to contact pieces in a prior art.
Figure 23:
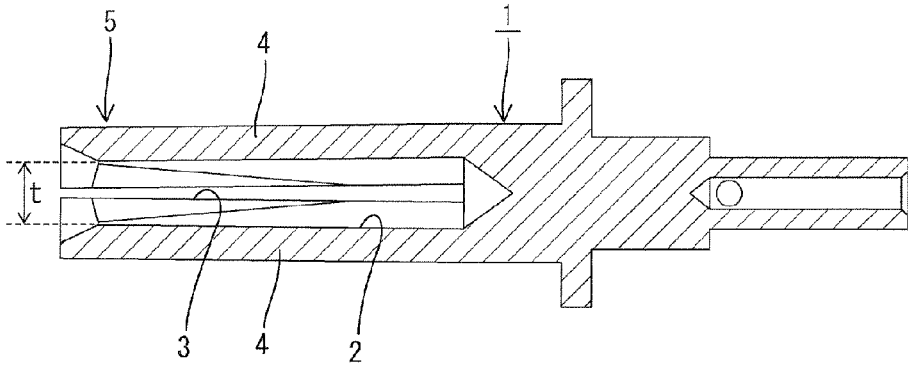
FIG. 23 PRIOR ART
FIG. 23 is a section showing a state after spinning is applied to the respective contact pieces in the prior art.

Although the contact portion is entirely held in surface contact with the male terminal 80 in the above embodiments, the arcuate or bent surfaces CS forming the contact portion may be held in contact with the male terminal 81 as shown in FIG. 20 in the case of the male terminal 81 having a small diameter.

Although the horizontal holes are formed to be long holes extending in forward and backward directions in the above embodiments, they may be formed as round holes and slits may be formed in a part planned to form the horizontal holes and other than the round hole according to the present invention.

Although the female terminal is produced by the cutting process in the above embodiments, it may be produced by a method other than cutting such as die-casting.

What is claimed is:

1. A method for producing a female terminal from a bar material extending in forward and backward directions, comprising:

forming elongate holes that open in lateral portions of the bar material, forming slits radially arranged about an axial center of the bar material to divide the bar material into the plurality of contact pieces, and setting a jig to substantially face outer surfaces of the contact pieces with a clearance defined between the jig and the outer surfaces of the contact pieces; and forming a terminal connection hole communicating with the elongate holes from a front end portion of the bar material in a state where the contact pieces are deformed resiliently into the clearance and held in contact with the jig.

2. The method of claim 1, wherein the terminal connection hole is formed by a drill having a diameter equal to an outer diameter of a male terminal to be connected to the female terminal.

3. The method of claim 2, wherein resilient displacement amounts of the contact pieces into the clearance correspond to resilient displacement amounts thereof when the male terminal is connected.

4. The method of claim 1, further comprising forming a guide hole in a front end portion of the bar material before forming the slit, and the terminal connection hole being formed relative to the guide hole.

5. The method of claim 4, wherein the guide hole is widened by an inclined surface at a leading end of the drill as the drill is inserted into the guide hole and the outer surfaces of the contact pieces contact inner circumferential surfaces of the jig to restrict resilient displacements of the contact pieces.

6. The method of claim 1, further comprising forming outer circumferential ribs on the outer circumferential surfaces of the contact pieces at positions substantially corresponding to a terminal connection hole.

7. The method of claim 6, wherein a distance from an opening edge of the jig to a leading end of the drill is set so that the outer circumferential ribs are accommodated into the jig before an inclined surface at a leading end of the drill contacts the inner circumferential surface of the guide hole to widen the guide hole, and the outer circumferential ribs slide in contact with the inner circumferential surface of the jig with the contact pieces resiliently deformed by a specified amount.

* * * * *